United States Patent [19]

McKearin

[11] 4,099,624

[45] Jul. 11, 1978

[54] PORTABLE BOOK RACK

[76] Inventor: John W. McKearin, P.O. Box. 118, Saugatuck Station, Westport, Conn. 06880

[21] Appl. No.: 793,888

[22] Filed: May 5, 1977

[51] Int. Cl.[2] ..... A47B 65/00

[52] U.S. Cl. ..... 211/42; 211/184

[58] Field of Search ..... 211/42, 43, 183, 184; 248/447, 448, 450, 457; D6/106, 184, 185; 108/60, 28

[56] References Cited

U.S. PATENT DOCUMENTS

| | | | |
|---|---|---|---|
| 488,983 | 1/1893 | Byrkit | D6/184 X |
| 489,693 | 1/1893 | Sargent | 211/43 |
| 1,828,249 | 10/1931 | Hammond | 211/43 X |
| 2,096,634 | 10/1937 | Gilbert | 211/43 |
| 2,915,193 | 12/1959 | Bromberg | 211/184 X |

*Primary Examiner*—Roy D. Frazier

*Assistant Examiner*—Terrell P. Lewis

*Attorney, Agent, or Firm*—Allen D. Brufsky

[57] ABSTRACT

A portable book rack including a pair of side bars having facing surfaces joined together at their ends by a pair of cross bars. A bookend is pivotably and removably connected between each end of the side bars so as to pivot from a substantially upright position supporting a plurality of books therebetween to a flat position for storage and/or shipping substantially coplanar and between the side bars. The facing surfaces of the side bars are provided with one or more pairs of facing and aligned vertical slots for receiving one of the bookends to adjust the relative distance between the bookends. Alternatively, an additional bookend can be used as a divider between the first pair of bookends by insertion between one pair of the facing and aligned vertical slots formed in the side bars.

11 Claims, 7 Drawing Figures

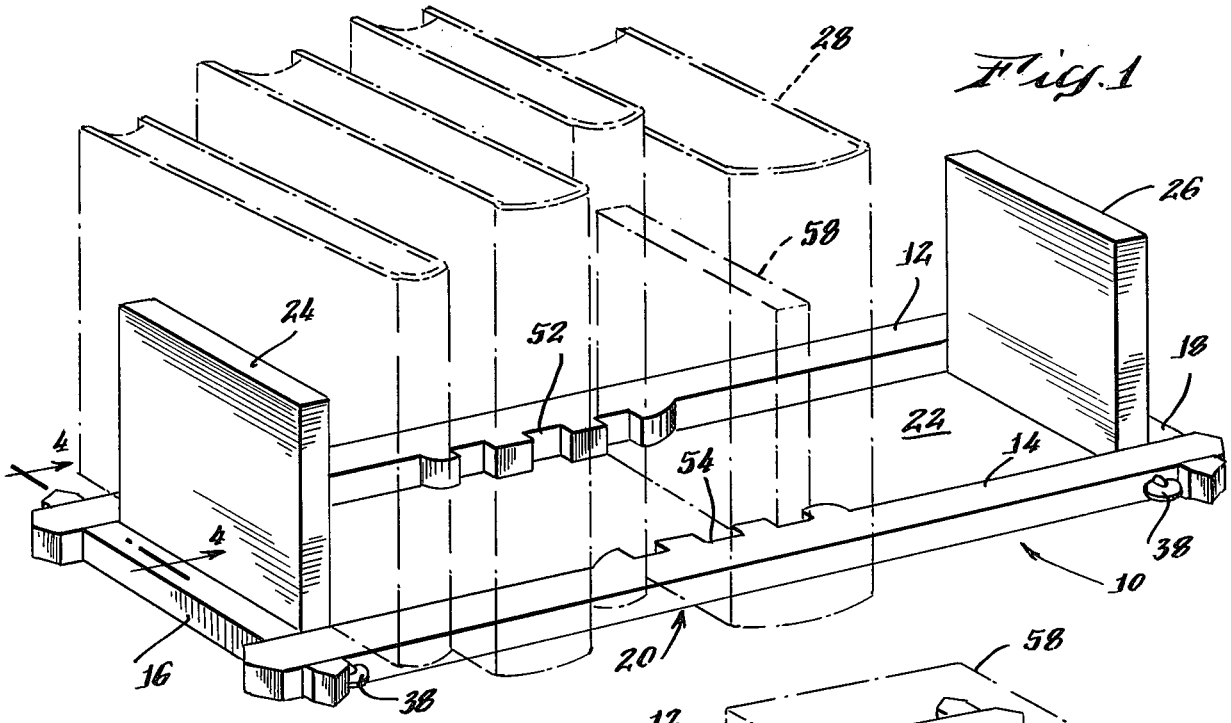
Fig. 1
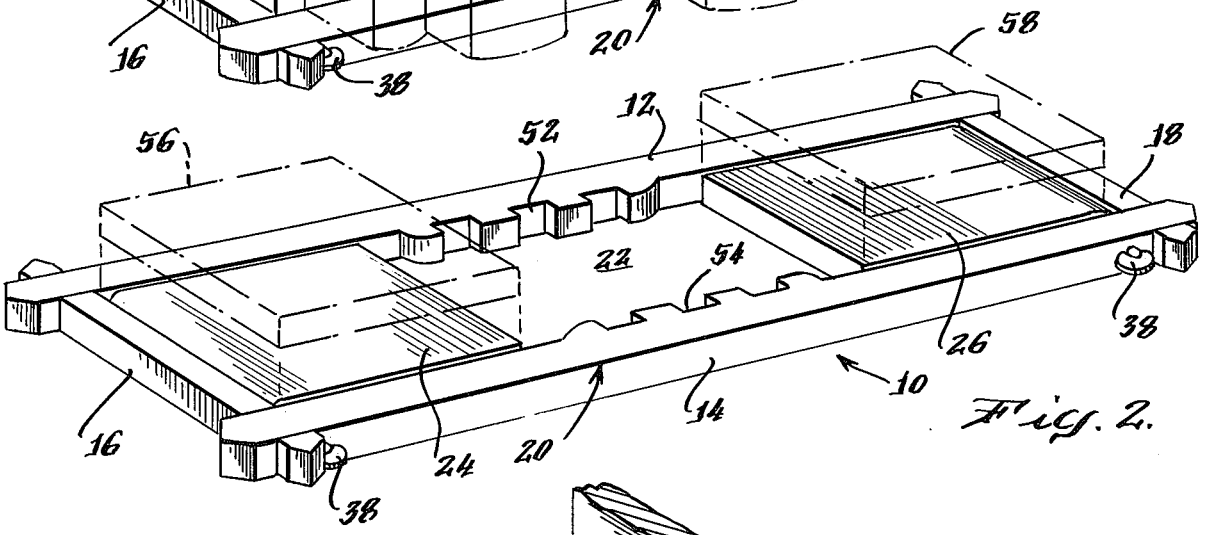
Fig. 2.
Fig. 3.
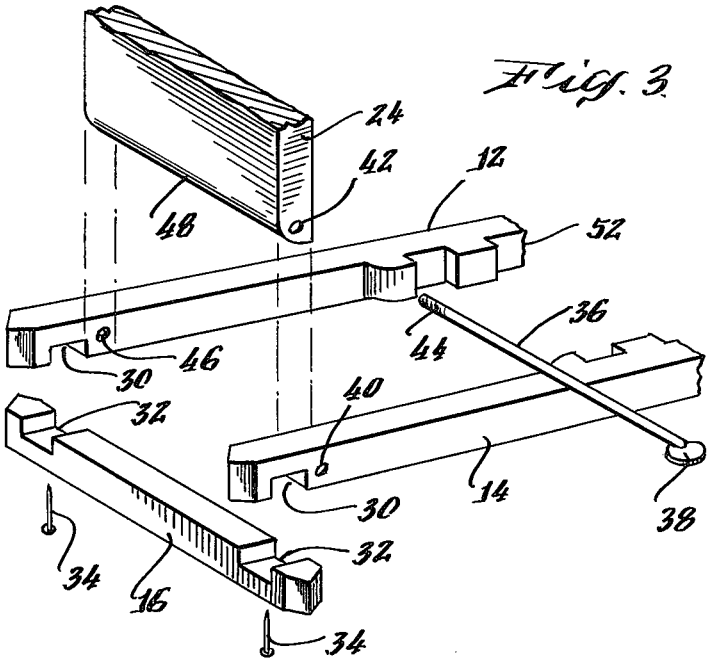
Fig. 4.
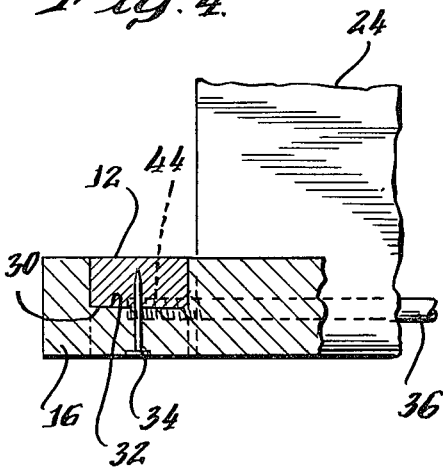

PORTABLE BOOK RACK

PRIOR ART

The following U.S. Pat. Nos. are known to the Applicant and are considered relevant to the present invention:

1,891,420
2,140,656
2,206,133
2,545,844
2,624,466
2,684,765
3,068,567
3,171,542
3,318,454
3,389,805

BACKGROUND OF THE INVENTION

1. Field of the Invention

This invention relates to a book rack, and more particularly, an adjustable, portable book rack adapted to be knocked down for storage and/or shipping.

2. Description of the Prior Art

The prior art is replete with book racks provided with adjustable bookends slidable in an upright condition along a base for adjusting the width between the bookends to support a plurality of books. For example, U.S. Pat. No. 1,891,420 illustrates a pair of bookends, each of which is provided with a flange which is slidable along the base of the rack. Because of the various adjustment features of the prior art book racks wherein the bookends slide relative to each other on a base, the book racks contain bookends which are incapable of being knocked down to a flat condition, substantially coplanar with the base, for compact shipment or storage.

U.S. Pat. No. 3,063,567 is the only prior art book rack known to the Applicant which contains bookends which are slidable relative to each other on the base of the book rack to adjust the distance therebetween and which can be pivoted to a substantially flat position within the interior of the base for shipment or storage. In order to accomplish this, the patentee forms both the base and bookends from wire. The lower wire cross rod of each bookend is bent back upon itself at its opposite ends to form a substantially C-shaped flange which pivotably engages one of the parallel outer wire rods of the base so as to be able to pivot the bookend to a flat condition, while upon tilting of the bookend it can slide on the base to relatively adjust the distance from the other bookend. Friction sleeves are provided at the end of the C-shaped flanges for frictionally engaging the wire rods when the bookends are in an upright condition. While the book rack disclosed contains the desirable functional characteristics of adjustability and collapsibility, it is of necessity flimsy and unattractive because of the necessity of forming the book rack from wire members to achieve the noted results.

The present invention provides a book rack which is both adjustable and collapsible, but because of the manner in which it is constructed to achieve these results, it can be fabricated to have an attractive appearance and sturdy configuration.

SUMMARY OF THE INVENTION

The book rack of the present invention includes a base made from four wooden bars routed at their ends and interconnected by rabbet joints in the configuration of an open rectangle. The rabbeted joints are adhesively connected and additionally held in place by nails. An elongated pin having a head at one end and threaded at its opposite end is inserted through one of the side bars of the base and a solid wooden bookend adjacent each opposite end of the cross bars of the base connecting the side bars. The threaded end of the pin is threadedly connected to a facing parallel side bar of the frame. Accordingly, each of the bookends connected to the base can pivot from a coplanar position within the interior of the open rectangular base to an upright position at each end of the base. The bottom edge of each bookend is rounded to permit pivotable movement of the bookend. When in an upright condition, one side of the bookend will abut one of the adjacent wooden cross bars of the base to retain the bookend in a substantially upright condition so a plurality of books can be supported between the bookends.

An inner surface intermediate the ends of each of the side bars of the base is also routed to form one or more pairs of facing aligned vertical slots. By merely unthreading one of the pins, a bookend may be removed and reinserted in a vertical orientation between a pair of facing and aligned slots in each of the side bars to adjust the distance between the bookends. Alternatively, one or more additional bookends can be provided for insertion in a pair of facing and aligned slots in the side rods to provide a divider between the bookends to group various books or other articles.

When the bookends are pivoted to a position coplanar with the base, the rack may be conveniently shipped or stored in a substantially flat condition occupying a minimum of space. If additional bookends are provided with the rack these may simply be stacked on top of the collapsed planar rack for convenience in shipping or storage.

BRIEF DESCRIPTION OF THE DRAWING

Further objects and advantages of the invention will become apparent from the following description and claims, and from the accompanying drawings, wherein:

FIG. 1 is a perspective view of the book rack of the present invention in its use condition supporting a plurality of books illustrated in phantom lines between a pair of bookends;

FIG. 2 is a perspective view similar to FIG. 1, except that the bookends of the book rack have been pivoted to a coplanar position with the base of the book rack for storage and/or shipment, and further illustrating in phantom lines the position of a pair of auxiliary bookends which can be used with the book rack of the present invention during storage and/or shipment;

FIG. 3 is an exploded perspective view of the left-hand end of the book rack of FIG. 1;

FIG. 4 is a cross sectional view taken substantially along the plane indicated by line 4—4 of FIG. 1;

DETAILED DESCRIPTION OF THE PREFERRED EMBODIMENTS

Figure 5:
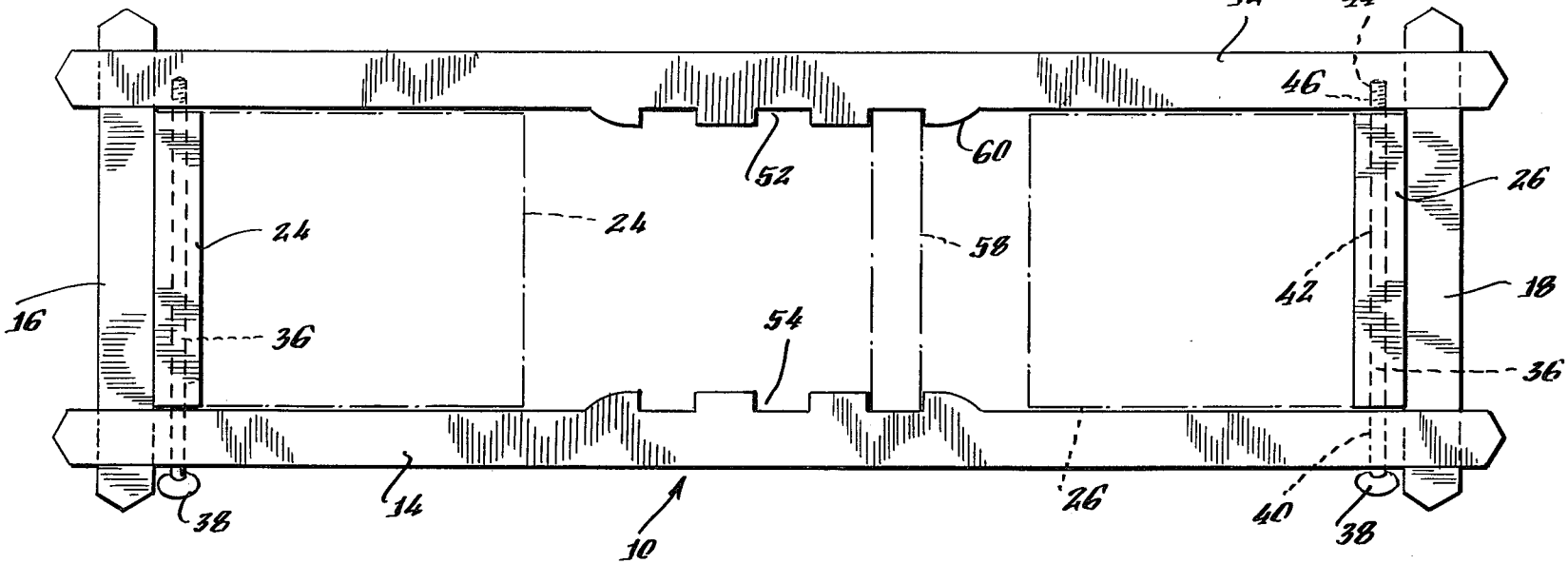
FIG. 5 is a top plan view of the rack of FIG. 1.

Referring now to the drawings in detail, wherein like numerals indicate like elements throughout the several views, one form of the portable book rack of the present invention is illustrated in FIGS. 1 to 6, inclusive, by the numeral 10.

Book rack 10 is formed from a pair of longitudinal, wooden side bars 12 and 14 disposed parallel to each other and connected to a pair of wooden cross bars 16 and 18. The bars 12, 14, 16 and 18 form the base 20 of book rack 10. Base 20 has a hollow interior 22 to receive a pair of bookends 24 and 26 pivotably connected between side bars 12 and 14 at opposite ends thereof. When disposed in an upright position, bookends 24 and 26 can support a plurality of books 28 therebetween, which books are also supported on the top surface of each of the longitudinal side bars 12 and 14. For shipment and/or storage, the bookends 24 and 26 can be pivoted to a position substantially coplanar with bars 12 and 14 within the hollow interior of base 20, as shown in FIG. 2.

As shown in FIGS. 3 and 4, the bottom surface of each of the bars 12 and 14 is routed at opposite ends thereof to form a groove or channel 30. Similarly, the upper surface of each of the end or cross bars 16 and 18 is routed to form a channel or groove 32. Facing channels 30 and 32 are interleaved to integrally connect bars 12 and 14 to the ends of cross rods 16 and 18. The rabbet joint can be frictionally as well as adhesively connected by coating the interior surfaces of the channels 30 and 32 with adhesive. Additionally, fasteners such as nails 34 can be driven from the bottom surface of each of the bars 16 and 18 into the side bars 12 and 14 to assure that the base 20 will remain integrally intact.

An elongated metal pin 36 having a wing-shaped head 38 is inserted through a bore 40 at each end of side bar 14 and through an aligned bore 42 in one of the bookends 24 and 26. The end of each pin 36 is threaded at 44 and received in a threaded bore 46 aligned with the other end of the bore 42 in one of the bookends 24 and 26. Each of the bookends 24 and 26 are thus integrally connected to side bars 12 and 14 but can pivot from the position illustrated in FIG. 1 to the coplanar position illustrated in FIG. 2 about the central portion of its mounting pin 36.

Figure 6:
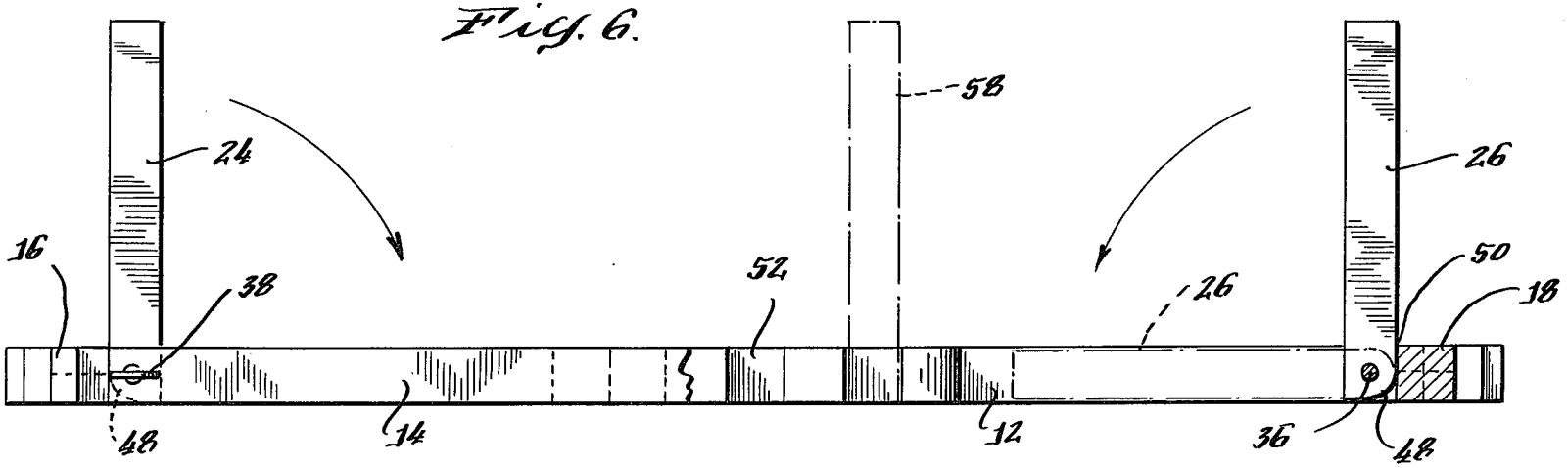
FIG. 6 is a front view in elevation of the book rack of FIG. 5, with the right-hand portion partly broken away and in section to illustrate the mode of use of the book rack.

The bottom surface of each bookend 24 and 26 is rounded at 48, that is, at its lower end adjacent to the cross rods 16 and 18, respectively, so that as shown in FIG. 6, each of the bookends can pivot with sufficient clearance from its upright support position to the coplanar flat storage and/or shipping position. When in an upright position, the rear surface of each bookend will abut the respective adjacent cross bar along a lower surface 50 to retain the bookend in its upright support position. The ends of each of the side bars 12 and 14, as well as the ends of each of the cross bars 16 and 18 can be beveled for decorative purposes.

A plurality of facing and aligned pairs of vertical slots 52, 54 can be formed on the facing surfaces of each of side bars 12 and 14 intermediate its end. Slots 52 and 54 may be formed by routing each of the side bars 12 and 14 or may be provided by a separate strip of material adhered to the facing surfaces of side bars 12 and 14.

In order to adjust the relative distance between bookends 24 and 26, one of the pins 36 may be threadedly removed from the aligned bores 40, 42 and 46 and placed between a pair of the facing slots 52, 54 intermediate the ends of side bars 12 and 14. As shown in FIGS. 5 and 6, the bookend 26 has been so removed, as illustrated in phantom, and relocated in a position supported by the sides of a pair of the slots 52, 54 and the support surface beneath base 20. By so repositioning the bookend 26, the relative distance between the bookends 24 and 26 can be adjusted, as required, to support less than a full compliment of books on rack 10.

Alternatively, auxiliary bookends 56 and 58 may be provided with the rack 10 for use as either dividers between groups or sets of the books 28 by inserting one or more of auxiliary bookends 56 and 58 between a pair of the facing slots 52, 54 intermediate the bookends 24 and 26. The auxiliary bookends 56 and 58 may be stored and/or shipped in a flat condition on top of the collapsed bookends 24 and 26, as shown in FIG. 2. The auxiliary bookends 56 and 58 need not be provided with a rounded corner 48. It will be noted from FIG. 5, that the ends 60 of each of the auxiliary side strips providing the facing pairs of slots 52, 54 may be rounded for decorative purposes.

Figure 7:
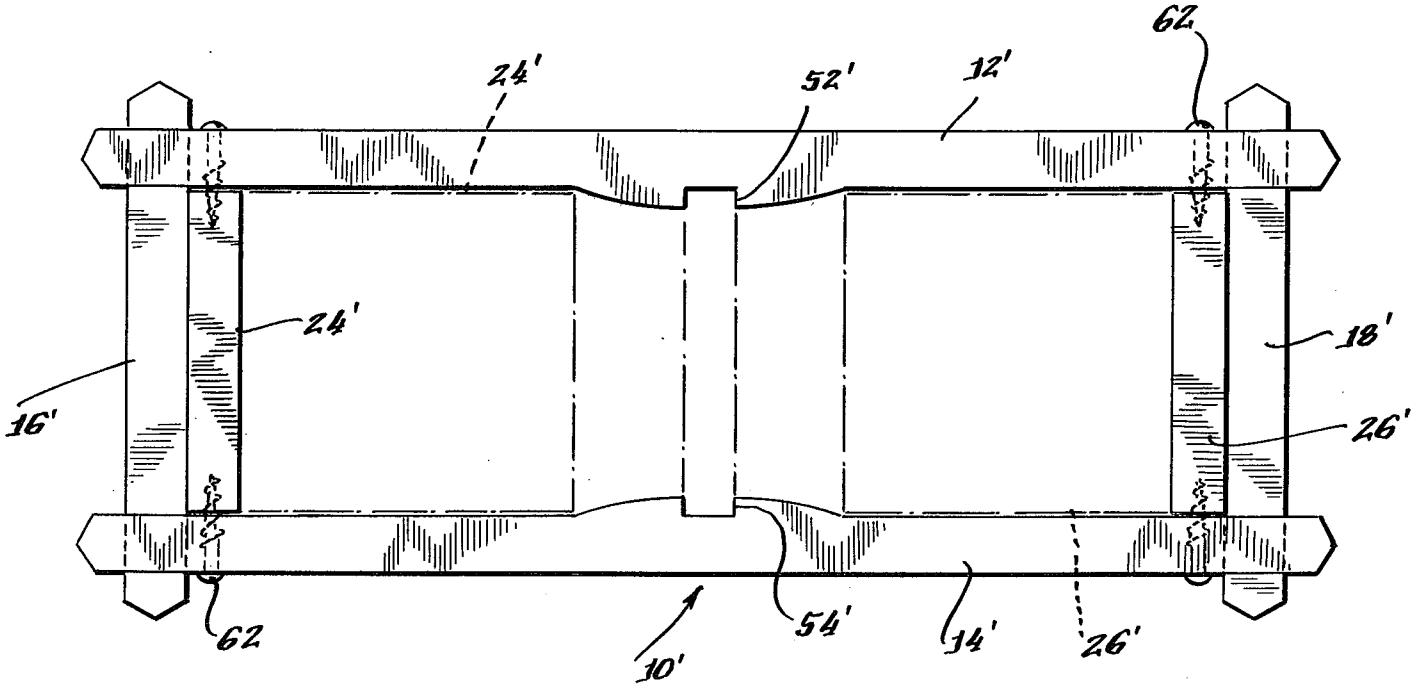
FIG. 7 is a top plan view of an alternate form of the book rack of the present invention.

FIG. 7 illustrates an alternative form of the book rack designated as 10'. Numerals indicating identical elements to those illustrated in FIGS. 1 to 6 are indicated by primed numerals.

The book rack 10' is substantially identical in construction to the book rack 10 except that only one pair of slots 52', 54' are provided intermediate the ends of the side bars 12' and 14' to receive an auxiliary divider bookend 56'. The divider 56' is primarily used to divide the support space of rack 10' into two distinct areas. Accordingly, the book rack 10' may include bookends 24' and 26' integrally connected to side bars 12' and 14' by wood screws 62, as there is no need to relocate either of the bookends 24' or 26' between the facing slots 52' and 54'.

What is claimed as new is:

1. A portable book rack comprising:

a base, said base including a pair of elongated side bars each having a surface thereof facing the other, and a pair of cross bars, each of said cross bars connecting opposed ends of said side bars, said side bars having an upper surface for supporting a plurality of books or like articles thereon, a bookend pivotably connected to each of said side bars at opposite ends thereof adjacent said cross bars, at least one of said bookends being removably mounted between the side bars of said base, each of said bookends including a surface for abutment with its adjacent cross bar when in a substantially upright position and a rounded corner adjacent said cross bar enabling said bookend to pivot to a position between said side bars substantially coplanar therewith, and means on the facing surfaces of said side bars intermediate the ends of each side bar defining a pair of aligned, substantially upright slots for receiving therebetween a divider or one of said bookends which in conjunction with at least the other of said bookends will support one or more books therebetween.

2. A book rack in accordance with claim 1 wherein said pivotable mounting means includes an elongated pin received through one of said side bars and bookends and threadedly inserted within the other of said side bars, said elongated pin having a threaded end threadedly received in said other side bar.

3. A book rack in accordance with claim 2 wherein said pin has an enlarged head on its end opposite to said threaded end.

4. A book rack in accordance with claim 1 wherein said means defines a plurality of pairs of facing and aligned slots on each of the facing surfaces of the side bars of said base.

5. A book rack in accordance with claim 1 including an additional bookend for use as said divider.

6. A book rack in accordance with claim 1 wherein each of said side bars and cross bars is formed from wood having a substantially rectangular cross section.

7. A book rack in accordance with claim 1 wherein said side bars are connected to said cross bars by individual rabbet joints.

8. A book rack in accordance with claim 7 wherein said rabbet joints are adhesively connected.

9. A portable book rack comprising:

a base, said base including a pair of elongated side bars each having a surface thereof facing the other, a pair of cross bars, each of said cross bars connecting opposite ends of said side bars, said side bars having an upper surface for supporting a plurality of books or like articles thereon, a bookend pivotally and removably mounted to and between each of said side bars at opposite ends thereof adjacent said cross bars, and means on the facing surfaces of said side bars intermediate the ends of each side bar defining at least one pair of aligned, substantially upright slots adapted to receive therebetween a divider or one of said bookends which in conjunction with one or the other of said bookends will support one or more books therebetween.

10. A book rack in accordance with claim 9 including at least one additional bookend for use as said divider adapted to be received between said pair of aligned, upright slots.

11. A portable book rack comprising:

a base, said base including a pair of elongated side bars each having a surface thereof facing the other, a pair of cross bars, each of said cross bars connecting opposite ends of said side bars, said side bars having an upper surface for supporting a plurality of books or like articles thereon, a bookend pivotally mounted to and between each of said side bars at opposite ends thereof adjacent said cross bars, means on the facing surfaces of said side bars intermediate the ends of each side bar defining pairs of aligned, substantially upright slots, and a pair of additional bookends, each adapted to be received between a pair of said aligned, upright slots.

* * * * *